United States Patent [19]

Dahan

[11] Patent Number: 4,726,376

[45] Date of Patent: Feb. 23, 1988

[54] NIPPLE FOR THE FEEDING OF NURSING INFANTS, OR FOR STIMULATION OF THEIR BUCCAL MOTIONS

[75] Inventor: José Dahan, Kraainem, Belgium

[73] Assignee: Rodam S.A., Geneva, Switzerland

[21] Appl. No.: 857,295

[22] Filed: Apr. 29, 1986

Related U.S. Application Data

[60] Division of Ser. No. 778,160, Nov. 18, 1985, Pat. No. 4,586,621, which is a continuation of Ser. No. 460,956, Jan. 25, 1983, abandoned.

[30] Foreign Application Priority Data

Feb. 1, 1982 [CH] Switzerland ..... 592/82

[51] Int. Cl.[4] ..... A61J 17/00

[52] U.S. Cl. ..... 128/360; 128/359; 215/11.1

[58] Field of Search ..... 128/359, 360; 215/11 R

[56] References Cited

U.S. PATENT DOCUMENTS

| | | | |
|---|---|---|---|
| 2,462,786 | 2/1949 | Steckler | 128/360 |
| 2,520,773 | 8/1950 | Muller | 128/360 |
| 2,717,473 | 9/1955 | Moore | 128/359 |
| 3,115,139 | 12/1963 | Schneider | 128/359 |
| 3,221,444 | 12/1965 | Hettinga | 128/359 |
| 3,283,758 | 11/1966 | Killebrew | 128/359 |
| 3,935,405 | 1/1976 | Auer | 128/359 |
| 4,554,919 | 11/1985 | Hubert | 128/360 |
| 4,586,621 | 5/1986 | Dahan | 128/360 |

*Primary Examiner*—C. Fred Rosenbaum
*Assistant Examiner*—Gene B. Kartchner
*Attorney, Agent, or Firm*—Krass & Young

[57] ABSTRACT

The nipple (1) affixed to a bottle of a nursing infant (2) by means of ring (3) comprises a semi-rigid internal membrane (5) which limits the chamber reservoir (11). Said reservoir extends by means of a lactiferous duct which ends in an opening (9) normally closed by zone (8) of the thin elastic membrane (7) which covers internal membrane (5). During suction, zone (8) of the membrane (7) swells as it becomes filled with liquid from the lactiferous duct, expelling of the liquid into the mouth being then obtained by pinching of teat (8) between the lips, and the ejection of the liquid through opening (10) which then is uncovered.

5 Claims, 5 Drawing Figures

NIPPLE FOR THE FEEDING OF NURSING INFANTS, OR FOR STIMULATION OF THEIR BUCCAL MOTIONS

This application is a division of application Ser. No. 778,160, filed Nov. 18, 1985, now U.S. Pat. No. 4,586,621, which is a continuation of application Ser. No. 460,956, filed Jan. 25, 1983, now abandoned.

There are already known, especially through Austrian Pat. No. 321 474, nipples meant for the feeding of nursing infants fitted with auxiliary elements meant to produce certain particular effects, either during the use of the nipple or when same is set to use. The above-mentioned Austrian Patent divulges, for example, a nipple comprising a double membrane.

The purpose of those already known constructions, is however usually concerned with the preservation of the foods contained in the bottles on which the nipples are placed and, until now, it was not known to provide a nipple for the purpose of rendering easier and of improving the oral kinesthesia of nursing infants.

The present invention, on the contrary, has as its purpose to provide a nipple conceived from the perspective of that problem, and applicable to nipples meant for feeding as well as to false nipples such as the "suckers" used for the stimulation of buccal motions outside of feeding times.

In case of a quantitative deficit of mother's milk, the breast generally is replaced with a bottle and artificial milk.

Bottle feeding, which frees the mother, causes in the nursing infant a reduction of the gnostic and sensorial capabilities of his buccal cavity. Tactile reciprocity, which refines the buccal perception of the new-born is non-existent.

Breast feeding makes it possible for the child, while granting nutritional pleasure and satiety, to familiarize the child's buccal mucous membrane with the maternal epidermal sensitivity and with the erection of the teat. That physiological reaction of the mother, perfectly felt by the child, develops its tactile sense simultaneously with its gustatory sense. The secondary reflexes thus started will, completing the inborn suction-swallowing reflex, help the neuro-motor apprenticeship and help the establishing of a balanced oro-facial behavior. In bottle feeding, little attention has been paid to the nipple used, and to its substitute between feedings, which the sucker represents.

In the neuro-sensorial and stereognostic development of the child, however, those devices are essential since they establish the first contacts of the mouth with the external environment, and must make possible the first tactile stimulations of the buccal cavity.

Various epidemiological studies on the oral behavior habits have revealed a sensorial deficiency and a stereognostic incapacity in thumb sucker and tongue pulser children. The majority of those children had, in their antecedents, a persistent bottle feeding and they presented anomalies in dental and maxiliary positions.

The hypothesis of an association between neurosensoro-motor maturing, the tactile search with the mother and the poor dental-maxiliary positions could not be rejected.

The present invention rests on the preceding considerations, and has as its object to provide a nipple for the feeding of nursing infants, or for the stimulation of their buccal motions, characterized in that it comprises, for one part, a repeatedly deformable exercizer under the action of the buccal motions and, for the other part, a response device set into action by a deformation of the exercizer and the effect of which is perpectible by the nursing infant as being different from the reaction to the exercizer deformation.

As it will be seen below, various forms of execution of that invention may be developed in applications meant either for nipples used in the feeding of nursing infants, or for false nipples of the sucker type.

A few preferred embodiments of the invention are described below, as example only, and with reference to the attached drawing in which.

Figure 1:
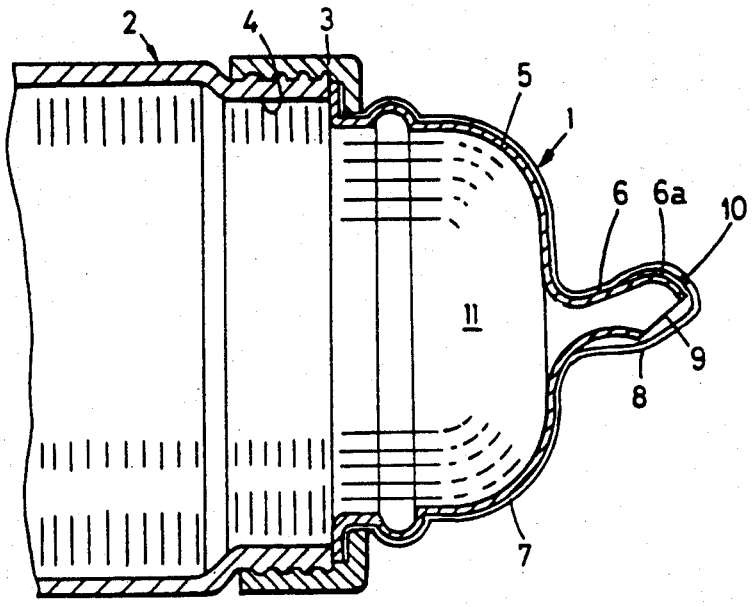
FIG. 1 is a section view of a first form of the nipple mounted on a feeding bottle for a nursing infant, the nipple being represented in its state of rest.
Figure 2:
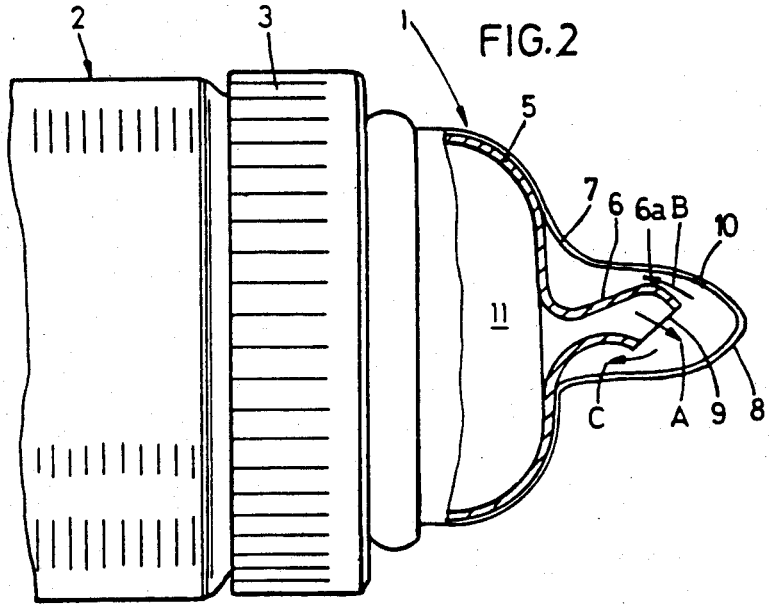
FIG. 2 is a view similar to that in FIG. 1, which shows the teat of the nipple in its swollen state.

Nipple 1 represented in FIGS. 1 and 2 is developed so that it can be mounted on a bottle 2 of the classical type. It comprises a fixation flange 3 which screws over the threaded neck 4 of bottle 2, a dome-shaped semi-rigid internal membrane 5 which forms a reservoir chamber 11 and which extends, at its summit in the form of a teat 6 the details of which will be given below, and an external membrane 7 thinner than membrane 5, elastically deformable, and engaged over membrane 5 in a manner such as to cover it entirely. The two membranes will be affixed, by their base, to flange 3, by means which need not be described here and which are common. In an advantageous form of execution, the two membranes could be formed integrally with each other.

The section views of FIGS. 1 and 2 show the arrangement of teats 6 and 8 of the internal membrane 5 and of the external membrane 7, in the state of rest and in the swollen state, said arrangement being represented in a vertically arranged plane at the time when the teat is seized by the nursing infant between his gums, with or without interposition of the tongue.

As it may be seen in the figures, the semi-rigid wall of teat 6 comprises on its upper side a globular zone 6*a* with double curvature, the end of which folds back downward, while, on its lower side, the semi-rigid wall of the teat 6 is shorter than on the upper side, and reaches, after a simple curvature, the opening 9 which ends teat 6. That opening, relatively large, thus is located in an oblique plane, and its axis is downward directed.

In the state of rest, the teat of internal membrane 5 is closed by the teat of external membrane 7. That part of membrane 7 also presents an opening indicated by 10 in the drawing. The latter is formed by one or several holes, but its total section is much smaller than that of opening 9. In the state of rest, the nipple is completely closed since opening 10 faces the globulous upper zone 6*a* of teat 6.

In FIG. 2 there is seen, on the contrary, the shape which external membrane 7 assumes at the time of suction and of pressure from the gum swellings of the nursing infant on the base of the teat. As it may be seen, the liquid contained in the bottle and in reservoir 11 of the nipple flows through the lactiferous duct formed by wall 6 and opening 9. It fills an antechamber-forming space which results from the swelling of teat 8, moving in the direction of arrow A. Membrane 7 then moves away from globulous zone 6a, so that the liquid can flow into the antechamber and to the outside of the wall of internal teat 6, along arrows B and C. Under the action of the pressure exerted by the gum swellings, the liquid then is expelled through openings 10 and into the mouth.

In other words, the natural suction motion which the nursing infant exerts on the part 8 of the external membrane of the nipple has as its result to cause the swelling of that zone of the external membrane which operates as exercizer, that creating a special tactile perpection which is absent in all nipple constructions known until now. That perpection is the source of the creating of new reflexes.

The exercizer thus takes part in the setting into place of the neuromotor circuits which govern the static and dynamic behavior of buccal members: tongue, lips, cheeks and mandibular muscles. Only a good functioning of the buccal members can prevent perturbations in the bone growth and help establish harmonious relationships between the teeth and the jaws.

In a preferred embodiment of the invention, the chamber reservoir 11 which forms the base of the nipple inside the semi-rigid membrane 5, will be definitely larger than the presently used common nipples. The semi-rigid wall of membrane 5 will preferably be reenforced by pillars in order to prevent any sinking effect resulting from the internal vacuum. The opening between the chamber reservoir 11 and the internal passage of teat 6 which constitutes the lactiferous passage, will be large enough to permit a rapid flow. The section of the lactiferous duct will, as seen in the Figure, first increase to a maximum section in globulous zone 6a which is itself rounded in order to fit the curvature of the palate before it opens on opening 9 the section of which again will be narrower and the axis of which is obliquely downward slanted.

The external membrane 7 will preferably be of thin rubber, so as to be perfectly extensible. The arrangement will be worked out so that at the time of suction, the teat 8 can extend to one and one half times its size at rest. Under the action of the antechamber filling perception, it has been observed that the nursing infant was incited to then cause the discharge of the liquid through opening 10, by means of a pressure of the tongue directed toward the anterior palate zone.

Figure 3:
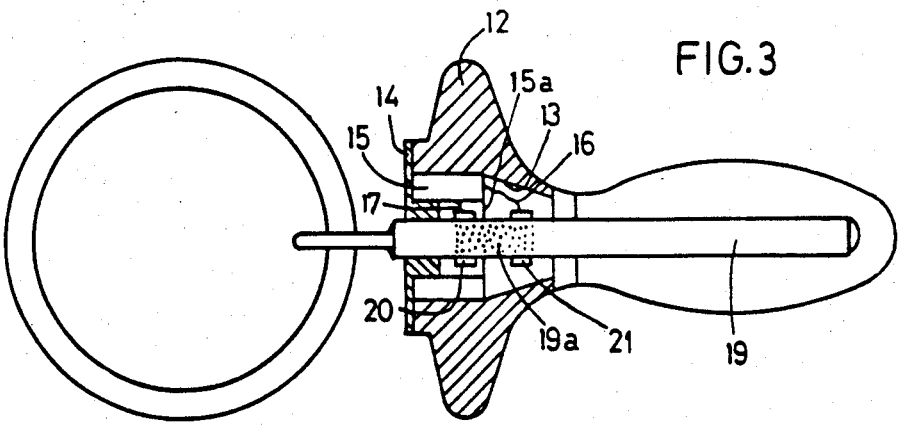
FIGS. 3 and 4 are section views, respectively in the horizontal and in the vertical plane, of a second form of the invention.
Figure 4:
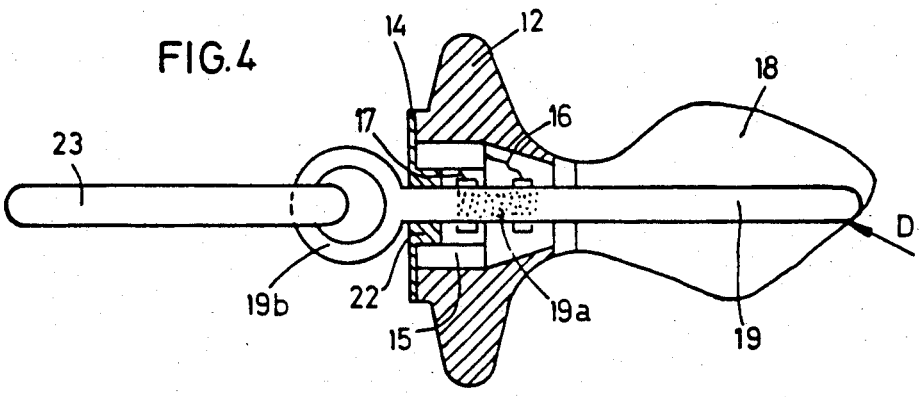
Figure 5:
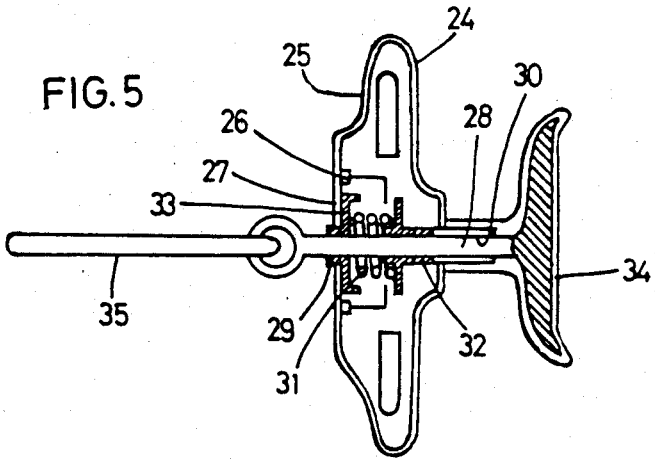
FIG. 5 is a section view of a third form of the invention.

The nipple represented in FIGS. 3 and 4 also is developed in a manner such that the effect of a buccal motion which, in this case is different from the suction motion acting as starting motion in the first form of execution, is perceptible by the nursing infant in a manner different than by the reaction of the element on which the starting motion is exerted.

That false nipple comprises a ring-shaped base of relatively rigid plastic material 12, comprising a central passage 13 which is closed by a rear plate 14. Inside ring-shaped base 12 there is lodged a device 15 capable of producing an emission perceptible by the nursing infant. Generally speaking, that emission may be of any type: visual, olfactive, gustatory or auditive. Thus, for example, device 15 might comprise a miniature music box works, or a musical module of the entirely electronic type, which can be connected and disconnected by a switch, and maintained by a miniature battery. In the form of execution represented in FIGS. 3 and 4, the complex formed by that device, which is ring-shaped, is lodged inside a closed and tight casing 15a. Only two connections 16 and 17, meant to be connected to the switch, come out of that casing. The latter may be affixed, for example, to the rear wall 14 of the object.

The two connection wires 16 and 17 are connected to the contacts of a switch which is meant to be engaged and disengaged under the action of buccal motions such as a pressure of the infant's tongue on a rigid or semi-rigid element lodged inside his mouth.

In the embodiment of the invention represented in FIGS. 3 and 4, the ring-shaped support 12 is extended by a flexible and elastic membrane 18 which imitates the shape of the teat of the nipple in FIG. 1. In addition, the exercizer lodged inside that teat is, in this case, a cylindrical bar 19 made of a semi-rigid material, a zone 19a of which is arranged so that it becomes conductive under the action of a mechanical solicitation. Bar 19 may be of rubber, for example, zone 19a being executed in a manner well known in itself, with incorporation of fine particles of copper buried in the mass of the rubber so that, under the action of a contraction, the particles come in mutual contact and zone 19a thus becomes conductive. As seen in FIGS. 3 and 4, two conductor rings 20 and 21 are further mounted around bar 19, at both ends of zone 19a, and the connection wires 16 and 17 are connected to those rings.

Of course, it would also be possible to imagine the exercizer 19 in another form, for example that of a construction comprising two rigid sections articulated to each other or coupled to each other, and held by means of springs for example, in a rectilinear position when the exercizer is at rest. The latter still could be arranged so as to react to more or less complex and elaborate motions. Thus, in an advantageous form of execution, instead of being constituted in the form of a semi-flexible bar, it could consist of an elastically extensible linear arrangement which however is normally kept rigid by an external sheath, said sheath being put out of action and unblocking a flexion motion following an extension the amplitude of which is pre-determined. With a construction of that type, the response device would be set into action as a result of a buccal motion comprising the combination of a suction force causing the extension of the exercizer, and of a flexion motion imposed by the tongue.

In any case, when the nursing infant applies his tongue from the bottom up under exercizer 19 (arrow D) while holding teat 18 pinched between his gum swellings which apply on the internal side of ring-shaped part 12, said exercizer is subjected to an upward deformation. Said deformation of course is felt as such by the buccal muscles but, in addition, the contraction of zone 19a causes the closing of the contact and it starts the musical production of device 15.

In this embodiment of the invention, bar 19 is mounted in a sliding manner inside a bearing 22 solidary of wall 14, and it presents a loop 19b at its external end, a loop to which there is hooked a traction ring 23. The infant thus can cause at will the musical emission, through a traction exerted on ring 23, part 12 being held back inside the mouth. But, under normal circumstances, the straightening of the end of the bar by means of the traction of the sliding rod of the ligual upward motion makes possible the start of the music. The end which can be straightened and a part of the sliding stem or rod are, with the sheath, covered with a rubber which allows for endo-buccal suction. The covering rubber maintains a rounded shape on its superior and lateral faces, and a flattened form on its interior face.

In the infants attempts to find between feedings, the security-filled situation of suction pleasure, it is going to condition, through the perception of the auditive, visual, olfactive or gustatory emission of the emitting device and the simultaneous straightening of the nipple, a reflex of mandibular forward motion and of ligual propulsion.

A third embodiment of the nipple according to the invention also constitutes a false nipple. Its purpose is to exercize the lips. It is meant, for example, for children older than nursing infants, who suffer from labial hypotonicity. The rigid part 24 constitutes a support capsule and it presents the shape of a circular disc. It plays the part of a vestibular screen which engages between the gum buds and the lips. Inside that base in the form of a casing, there is lodged the electronic device 25 of the same type as the device 15 in the preceding form of execution. The electric contact which closes to cause the musical emission is constituted, in this case, by a micro-switch 26 which may be affixed to the top or to the bottom, inside wall 27 which forms the center of membrane 24. The device further comprises a rigid bar 28 which slides in openings 20 and 30 of capsule 24, the sliding being held back by a spring 31 inserted between a disc 32 mounted on bar 28 and a fixed disc 33 placed inside wall 27. Bar 28 extends rearward by means of a second lateral element 33 in the shape of a disc which comes to insert itself inside the gum buds. A membrane 34 covers the rear of bar 28 and disc 33, while allowing the axial displacements of bar 28 relative to capsule 24. In that case also, a ring 35 makes it possible to execute by hand a traction on bar 28. The latter slides then in bearings 29 and 30 so that disc 32 will operate micro-switch 26.

In this exbodiment, the vestibular screen is intended to help the child to resist the labial closing upon traction on the ring, without using the mandibular lift. The musical start signals to the child that the traction to expel the exercizer from the mouth indeed has been fought by the lips and it stimulates it to increase its effort (biofeedback phenomenon). The tongue upwardly oriented by the end of the nipple, participates in that motion.

Other exercizers based on the same principle may be developed. For older children, it is possible to do without the endo-buccal end which can be straightened. The start of the music then may take place under the action of traction alone, exerted at the level of the lips and of the vestibular screen.

I claim:

1. An artificial nipple for infants comprising:

(A) a base portion;

(B) a deformable teat portion secured to said base portion and including an outer portion providing it with a predetermined shape at rest and an inner portion with which a resilient member is associated;

(C) an electrically powered emitting device integral with said base portion; and (D) drive means, including electrical contacts, operative to close an electrical circuit to said emitting device in response to deformation of said resilient member occurring in response to deformation of said test portion by the buccal muscles of a sucking infant, whereby to generate a sensory reactional signal perceptible to the infant independently of the second reactional deformation of said test portion and indicative of a change of state of said nipple from an inactive state to an active state brought about the sucking action of the infant.

2. An artificial nipple according to claim 1 wherein said resilient member comprises a resiliently flexible bar having one end secured to said base and the other end freely engaging said outer portion of said test portion and wherein said outer portion is deformable.

3. An artificial nipple according to claim 2 wherein said bar comprises successive rigid portions connected together through resilient means.

4. An artificial nipple according to claim 1 wherein said teat portion comprises a rigid member including a disk and a straight bar supported through sliding means with respect to said base; said resilient member comprises a spring, one end of which engages said bar and the other end of which engages said base; said base and said disk are shaped to form a vestibular screen and a tongue leaning support respectively; and said drive means is operated to activate said emitting device in response to sliding of said bar with respect to said base against the action of said spring.

5. An artificial nipple according to claim 4 wherein said bar is provided at the end thereof opposed to said disk with a gripping means which is operative to provide hand activation of said emitting device.

* * * * *

UNITED STATES PATENT AND TRADEMARK OFFICE

CERTIFICATE OF CORRECTION

PATENT NO. : 4,726,376

DATED : February 23, 1988

INVENTOR(S) : Jose Dahan

It is certified that error appears in the above-identified patent and that said Letters Patent is hereby corrected as shown below:

Column 5, line 37, "exbodiment" should be --embodiment--.

Column 6, line 17, "test" should be --teat--.

Column 6, line 21, "second" should be --sensed--.

Column 6, line 21, "test" should be --teat--.

Column 6, line 28, "test" should be --teat--.

Signed and Sealed this

Twenty-second Day of November, 1988

*Attest:*

*Attesting Officer*

DONALD J. QUIGG

*Commissioner of Patents and Trademarks*